US005634677A

United States Patent [19]

Büscher et al.

[11] Patent Number: 5,634,677

[45] Date of Patent: Jun. 3, 1997

[54] POWER-LOCKING MOTOR-VEHICLE DOOR LATCH

[75] Inventors: Hans-Joachim Büscher; Alexandra Pelz, both of Düsseldorf; Klaus-Dieter Feist, Wuppertal; Armin Handke, Duisburg, all of Germany

[73] Assignee: Kiekert Aktiengesellschaft, Heiligenhaus, Germany

[21] Appl. No.: 503,404

[22] Filed: Jul. 17, 1995

[30] Foreign Application Priority Data

| | | | |
|---|---|---|---|
| Sep. 1, 1994 | [DE] | Germany | 44 31 142.7 |
| Dec. 16, 1994 | [DE] | Germany | 44 45 043.5 |
| May 6, 1995 | [DE] | Germany | 195 16 738.4 |

[51] Int. Cl.[6] ..... E05C 3/06

[52] U.S. Cl. ..... 292/216; 292/DIG. 27; 292/DIG. 23

[58] Field of Search ..... 292/216, DIG. 27, 292/DIG. 23

[56] References Cited

U.S. PATENT DOCUMENTS

| | | | |
|---|---|---|---|
| 5,464,260 | 11/1995 | Bartel et al. | 292/201 |
| 5,474,340 | 12/1995 | Brackmann et al. | 292/216 |
| 5,476,294 | 12/1995 | Menke | 292/216 |
| 5,494,322 | 2/1996 | Menke | 292/216 |

FOREIGN PATENT DOCUMENTS

| | | |
|---|---|---|
| 0 379 273 | 7/1990 | European Pat. Off. . |
| 0 267 423 | 5/1988 | Germany . |
| 39 24 209 | 3/1990 | Germany . |
| 39 24 210 | 3/1990 | Germany . |
| 40 09 276 | 10/1990 | Germany . |
| 39 24 231 | 8/1991 | Germany . |

*Primary Examiner*—Rodney M. Lindsey
*Assistant Examiner*—Steve Pentlicki
*Attorney, Agent, or Firm*—Herbert Dubno; Andrew Wilford

[57] ABSTRACT

A motor-vehicle door latch has a housing, a lock fork on the housing engageable with a door bolt, and a release pawl engageable with the fork. An actuating mechanism is connected to the release pawl via a coupling part displaceable on the housing so that in a decoupling position of the part actuation of the actuating mechanism does not affect the release pawl. A central locking element is displaceable on the housing generally parallel to a predetermined direction, is formed with a cutout opening transversely of the direction and having locking and unlocking flanks directed oppositely at least generally in the direction, and is formed to each side of the cutout with an abutment surface directed generally perpendicular to the direction. A locking mechanism jointly movable with the locking element is connected between the central locking element and the coupling part for displacing the coupling part into the decoupling position on displacement of the central locking element into its locked position and for displacing the coupling part into the coupling position on displacement of the central locking element into the unlocked position. A drive body rotatable about a drive axis has an eccentric pin formation defining on rotation of the drive body an orbit lying partially inside and partially outside the cutout. A reversible electric motor rotates the drive body and thereby orbits the pin formation about the drive axis.

16 Claims, 8 Drawing Sheets

POWER-LOCKING MOTOR-VEHICLE DOOR LATCH

FIELD OF THE INVENTION

The present invention relates to a motor-vehicle door latch. More particularly this invention concerns such a latch that can be locked and unlocked remotely, that is a power lock.

BACKGROUND OF THE INVENTION

A motor-vehicle door latch normally has a housing, a lock fork on the housing engageable with a door bolt and pivotable between a holding position engaged around the bolt and retaining it on the housing and a freeing position permitting the door bolt to move into and out of the housing, and a release pawl engageable with the fork and displaceable between a latched position retaining the fork in the holding position and an unlatched position unengageable with the fork and permitting the fork to move into the freeing position. An actuating mechanism is movable between an actuated position and an unactuated position and normally has an inside and an outside actuating lever connected to respective door handles. A coupling part is displaceable on the housing between a coupling position connecting the actuating mechanism to the release pawl for displacement of the release pawl into the unlatched position on displacement of the actuating mechanism into the actuated position and a decoupling position for disconnecting the actuating mechanism from the release pawl. Thus in the decoupling position actuation of the actuating mechanism does not affect the release pawl. A central locking element is displaceable on the housing between locked and unlocked positions and is connected via a locking mechanism normally also operable by at least an inside locking element with the coupling part for displacing the coupling part into the decoupling position on displacement of the central locking element into the locked position and for displacing the coupling part into the coupling position on displacement of the central locking element into the unlocked position. A drive body rotatable about a drive axis has an eccentric pin formation defining on rotation of the drive body an orbit lying partially inside and partially outside the cutout. A reversible electric motor rotates the drive body and thereby orbits the pin formation about the drive axis for moving the central locking element into the locked position and in the opposite direction for moving it into the unlocked position.

Thus such a latch can be locked or unlocked both manually or via the central-system motor. In particular it is important to be able to unlock a door when the central locking system has failed, for instance when the vehicle's battery has gone dead. In order to avoid having to move all the central-locking mechanism when thus manually unlocking the door, it is standard for the motor to reset to a neutral position after locking the door. In European patent document 0,267,423 of Hayakawa the central locking element is therefore a lever moved by the motor from the neutral position in one direction or the other to lock the door. A strong spring urges this lever back in to the neutral position and the motor is effective on the lever via a nonlocking worm drive, so that once the motor stops rotating the spring pulls the lever back to the neutral position. With such a system the spring must be strong enough to overcome the inherent resistance of the system and to back-drive the motor, and the motor must in its turn be strong enough to overcome the spring and the inherent resistance of the system. Hence the drive must be fairly bulky. Systems with similar operations and problems are seen in German 3,924,231, 4,009,276, 3,924,209, and 3,294,210 all of R. Fukumoto et al.

European 0,379,273 of S. Wilkes describes another system using a spiral drive that drive a pin mounted on a lever constituting the central locking element. At the end of its travel the lever cannot move, however, so that there is no possibility of a manual locking or unlocking of the latch. Although a spring return for manual unlocking in case of power failure is provided, it has the same disadvantage as the above-discussed prior-art systems.

In U.S. Pat. No. 4,709,738 of J. Ingenhoven an electrically operable central locking and unlocking device for vehicle doors is provided with electromechanical actuation for each lock. The actuation is transferred by a vertically movable actuating rod capable of moving between an unlocked position and a locked position to a control rod of the associated door lock. A reversible electric motor, transmission, and actuating mechanism are provided for the actuating rod. Exterior ridges on a spindle not and projecting formations which carry along the actuating rod during the lock stroke and during the unlocking stroke are provided. The ridges can rid, after completion of the lock stroke, over the projections as well as after completion of the unlock stroke. The spindle has a self-retarding thread on which is held the spindle nut that is formed with the ridges. Here also a very powerful motor must be provided to operate the lock.

OBJECTS OF THE INVENTION

It is therefore an object of the present invention to provide an improved power-actuated motor-vehicle door latch.

Another object is the provision of such an improved power-actuated motor-vehicle door latch which overcomes the above-given disadvantages, that is which can use a relatively light-duty motor, which is of simple construction, and which can be manually unlocked if necessary.

SUMMARY OF THE INVENTION

A motor-vehicle door latch has according to the invention a housing, a lock fork on the housing engageable with a door bolt and pivotable between a holding position engaged around the bolt and retaining it on the housing and a freeing position permitting the door bolt to move into and out of the housing, and a release pawl engageable with the fork and displaceable between a latched position retaining the fork in the holding position and an unlatched position unengageable with the fork and permitting the fork to move into the freeing position. An actuating mechanism movable between an actuated position and an unactuated position is connected to the release pawl via a coupling part displaceable on the housing between a coupling position connecting the actuating mechanism to the release pawl for displacement of the release pawl into the unlatched position on displacement of the actuating mechanism into the actuated position and a decoupling position for disconnecting the actuating mechanism from the release pawl so that in the decoupling position actuation of the actuating mechanism does not affect the release pawl. A central locking element is displaceable on the housing generally parallel to a predetermined direction between locked and unlocked positions, is formed with a cutout opening transversely of the direction and having locking and unlocking flanks directed oppositely at least generally in the direction, and is formed to each side of the cutout with an abutment surface directed generally perpendicular to the direction. A locking mechanism jointly movable with the locking element is connected between the central locking element and the coupling part for displacing the coupling part into the decoupling position on displacement of the central locking element into the locked position and for displacing the coupling part into the coupling position on displacement of the central locking element into the unlocked position. A drive body rotatable about a drive axis has an eccentric pin formation defining on rotation of the drive body an orbit lying partially inside and partially outside the cutout. A reversible electric motor rotates the drive body and thereby orbits the pin formation about the drive axis in one rotational sense for engaging the pin formation against the locking flank and displacing the central locking element into the locked position and thereafter engaging the pin formation against one of the abutment surfaces and thereby stopping the drive element and in the opposite rotational sense for engaging the pin formation against the unlocking flank and displacing the central locking element into the unlocked position and thereafter engaging the pin formation against the other of the abutment surfaces and thereby stopping the drive element.

Thus with this system the pin formation only is effective in one direction on the central locking element, which remains free to move in the opposite direction. Thus if the system has to be actuated manually, there is no need to exert enough force to overcome any drive, instead the locking element is just pulled out of contact with the pin formation. Since no return spring is provided, the drive motor need not be sufficiently powerful to overcome its force.

According to the invention a controller cuts electrical energization of the motor on stopping of the pin formation against either of the abutment surfaces. This can be done via limit switches or, more simply, simply by monitoring current consumption of the motor and shutting it off when this current consumption rises above a predetermined threshold as happens when the motor jams.

The housing according to the invention can have a guide in which the central locking element is slidable in a straight line parallel to the direction. The direction can be directly parallel to that of displacement of the door-locking button so that the locking element can be formed right on its shaft. Alternately both the inside locking lever and central locking element are pivotal about a common axis on the housing and in fact being the same part, that is integrally formed.

The locking element can also be pivotal about an element axis and the direction can therefore extend tangentially of an imaginary circle centered on the element axis. The cutout can be a radially outwardly open notch and the abutment surfaces radially outwardly directed edges of the locking element. In this case the drive body is rotatable about an axis substantially parallel to and offset from the element axis. In another system the cutout is an axially open recess formed in the central locking element and the abutment surfaces are radially inwardly directed.

The pin formation according to the invention can include a single pin and is rotatable through about 480° or 540° between end positions engaging the abutment surfaces. It can also be a pair of diametrically opposed pins that are rotatable through about 180° between end positions of the drive body in each of which a respective one of the pins engages a respective one of the abutment surfaces. Each abutment surface has an elastic coating that cushions the pin or pins and prevents them from wearing excessively or operating noisily.

The locking mechanism in accordance with this invention includes an inside locking lever directly connected to the coupling part for displacing same between its positions. The latch further has according to the invention an emergency-release coupling for disconnecting the locking element from the coupling part and displacing the coupling part into the coupling position when, in the locked position of the locking element, the actuating mechanism exerts on the coupling force a force exceeding a predetermined threshold force in a direction urging the coupling part into the coupling position so that the manual actuating mechanism can override the central locking element.

According to the invention the locking mechanism further includes an outside locking lever directly connected to the coupling part for displacing same between its positions and pivotal on the housing about the axis of the inside locking lever and central locking element. The emergency-release connection is a snap connection that only opens when the inside actuating lever is moved in a direction to unlock the latch while the central locking element is in the locked position. More specifically the locking mechanism includes a transmission lever connected between the locking mechanism and the coupling part and a spring connected between the transmission lever and the locking lever and urging the locking lever into the unlocked position.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
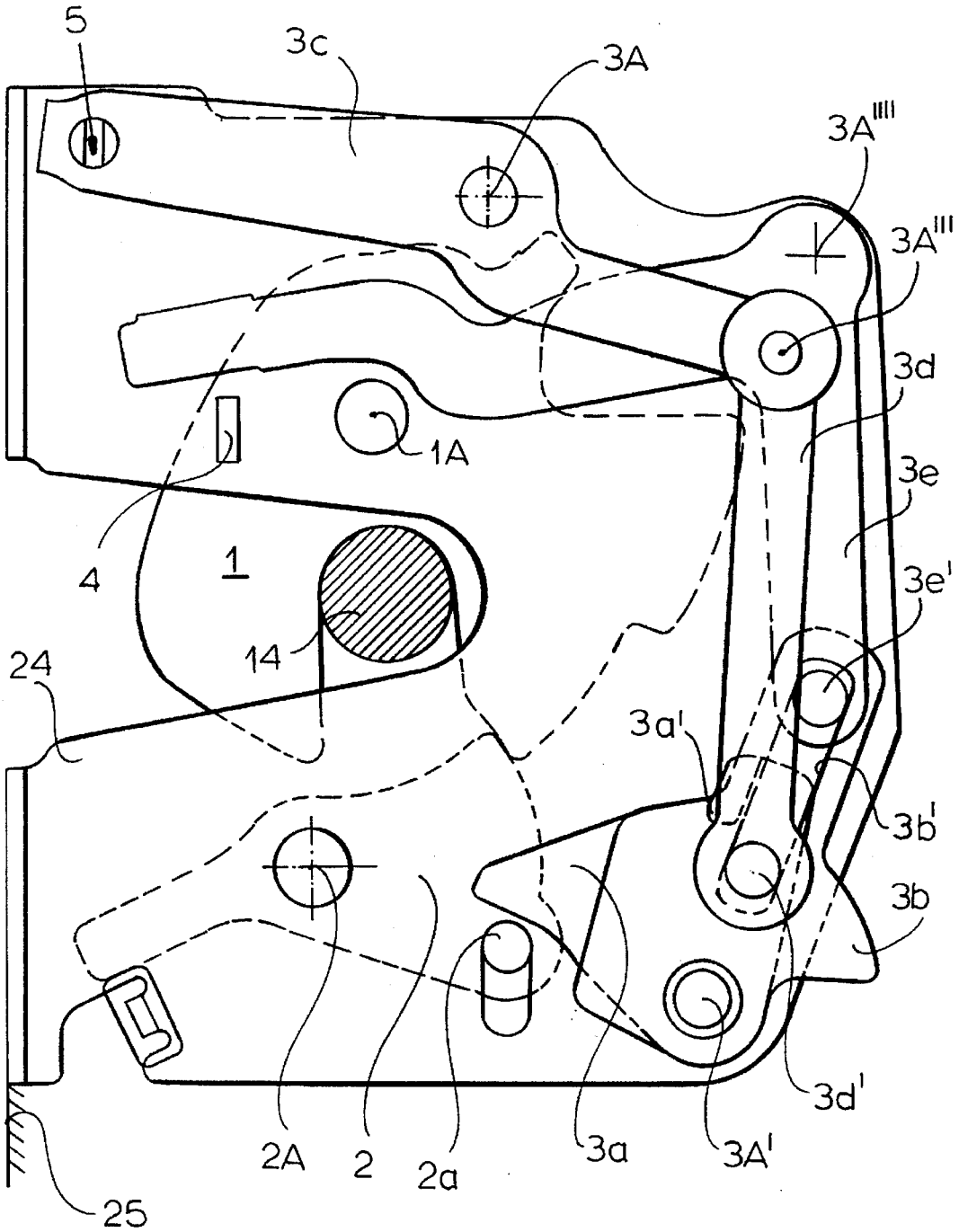
FIG. 1 is a vertical section through a latch according to the invention in the locked and latched position.

As seen in FIG. 1 a latch according to the invention has a housing 24 which is mounted on an edge of a door illustrated schematically at 25 and in which a fork 1 is pivotal about an axis 1A so as to trap and hold a bolt 14 extending from an unillustrated door post. A pawl 2 can secure the fork 1 in the illustrated holding position or can be pivoted about an axis 2A to allow the fork 1 to pivot clockwise and release the bolt 14. This pawl 2 carries a pin 2*a* projecting through a slot in the housing 24.

The housing 24 carries a release lever 3*a* pivotal about an axis 3A' parallel to the axes 1A and 2A, a guide 3*b* also pivoted on this axis 3A', a lever 3*c* pivoted about another parallel axis 3A", a link 3*d* pivoted at 3A'" on an end of the lever 3*c*, and an L-shaped lever 3*e* pivoted at an axis 3A"" on the housing 24. The lever 3*e* is acted on by an inside actuating lever 4 intended to move the latch between the latched and unlatched positions, respectively retaining and releasing the bolt 14. The lever 3*c* is acted on a by an inside locking lever 5 that displaces it between a locked and unlocked position. In the locked position actuation of the lever 3*e* by the locking lever 4 is not effective to release the bolt. Virtually identical structure is shown and described in detail in copending applications 08/184,247 and 08/184,250.

More specifically, the lower end of the link 3*d* carries a coupling part or pin 3*d*' which slides in a slot 3*b*' of the guide 3*b* and is engageable with an entrainment tab 3*a*' of the lever 3*a*. The lower end of the lever 3*e* carries a pin 3*e*' which rides in the slot 3*b*' above the pin 3*d*. Thus when the lever 3*c*, which forms a locking mechanism with the lever 5 and pin 3*d*, is in the locked position of FIG. 1, the pin 3*d* is below the tab 3*a*' and clockwise pivoting of the lever 3*e* will pivot the guide 3*b* and pin 3*d* counterclockwise, but since the pin 3*d*' is below the tab 3*a*', this pivoting will not be transmitted to the lever 3*a* and the lock will remain latched.

Figure 2:
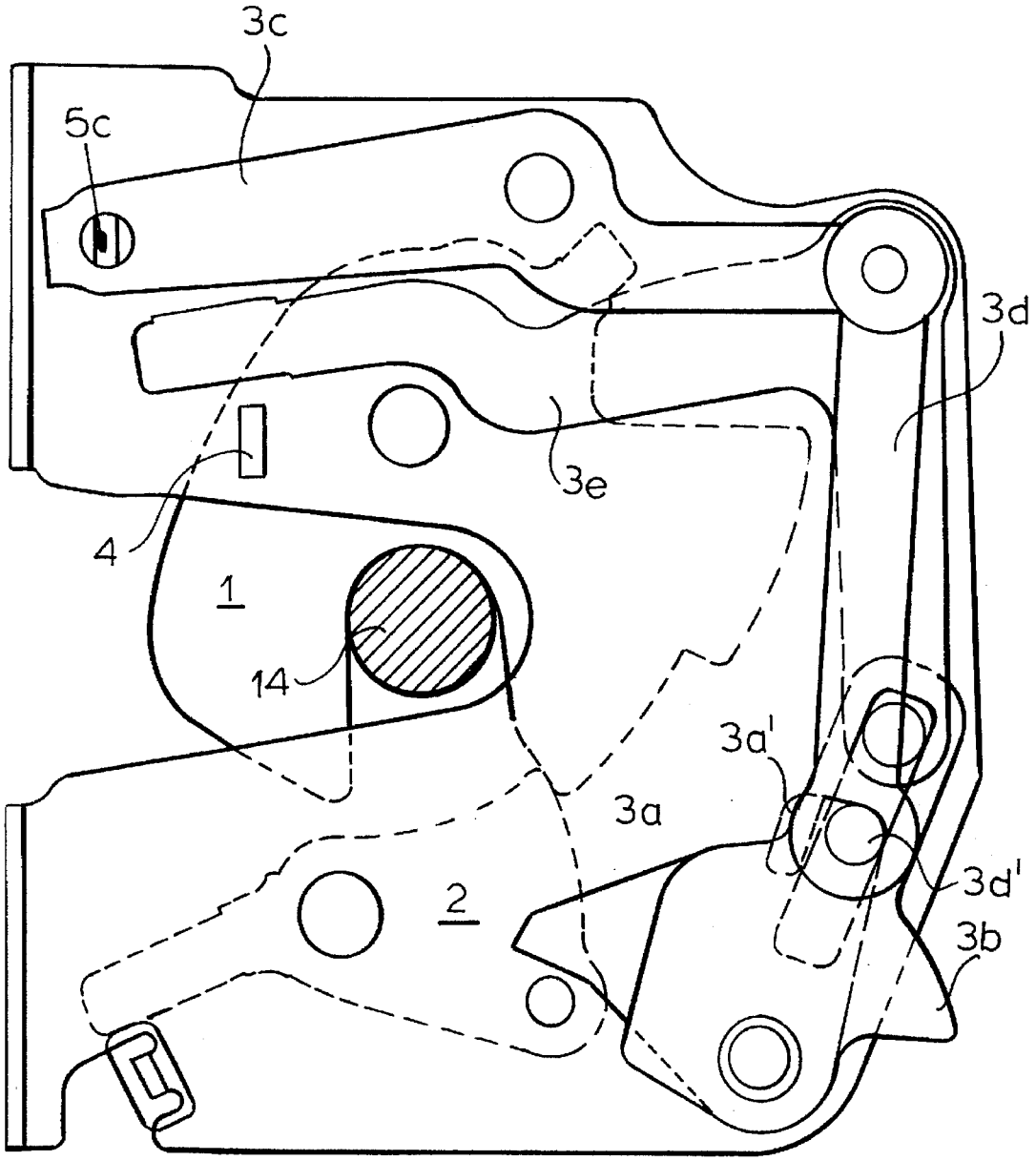
FIG. 2 is a view like FIG. 1 but with the latch in the unlocked and latched position.
Figure 3:
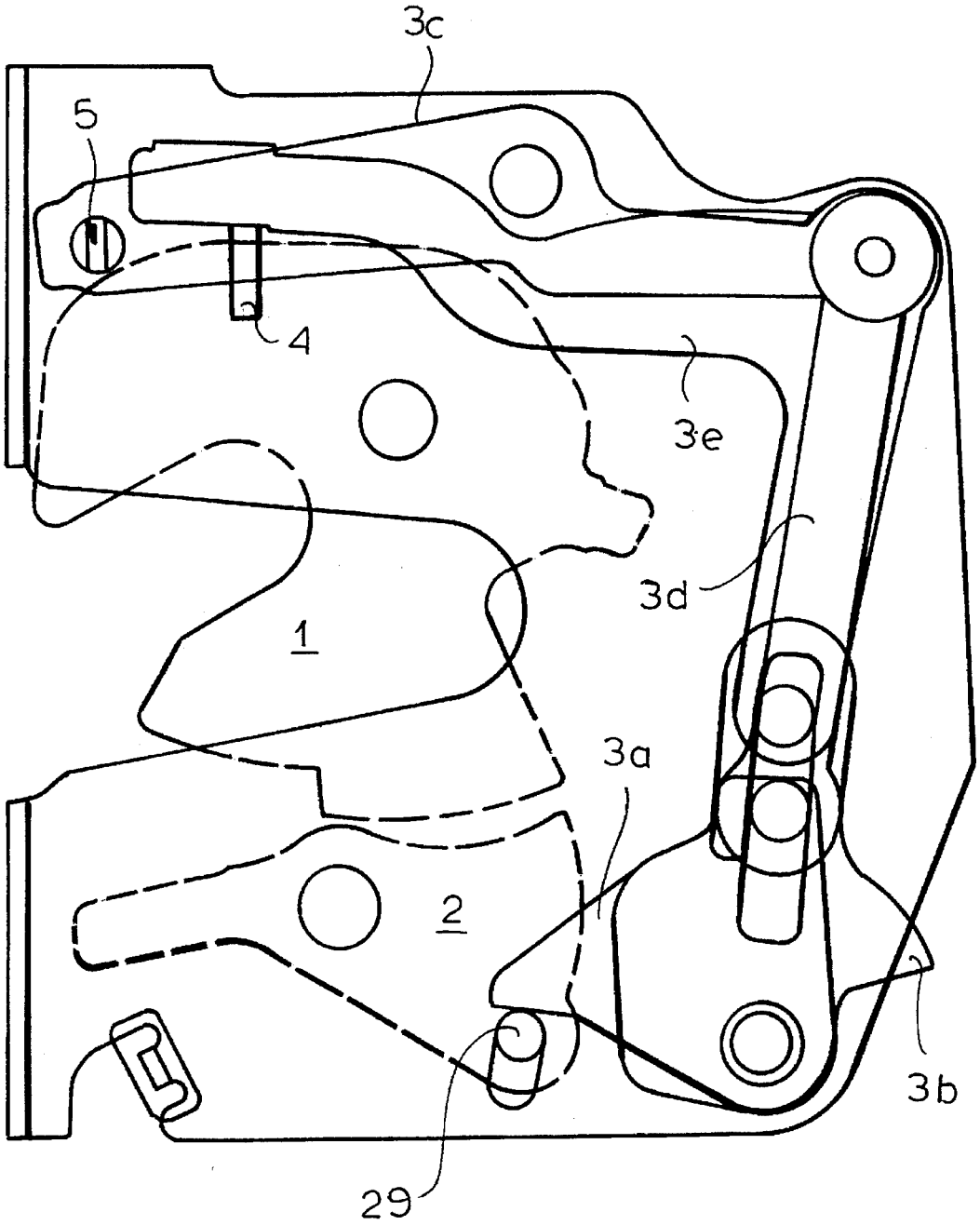
FIG. 3 is a view like FIG. 1 but with the latched in the unlocked and unlatched position.

When, however, as shown in FIG. 2 the lever 3*c* is pivoted somewhat clockwise into the unlocked position, the link 3*d* and pin 3*d*' are raised, putting this pin 3*d*' next to the tab 3*a*'. Subsequent clockwise pivoting of the lever 3*e*, which forms with the levers 4 and 3*b* and the pin 3*e*' an actuating mechanism, will therefore move the pin 3*d*' toward the left so that the lever 3*a* will act on the pin 2*a* and push the pawl 2 down as shown in FIG. 3, unlatching the latch and releasing the bolt 14.

Figure 4:
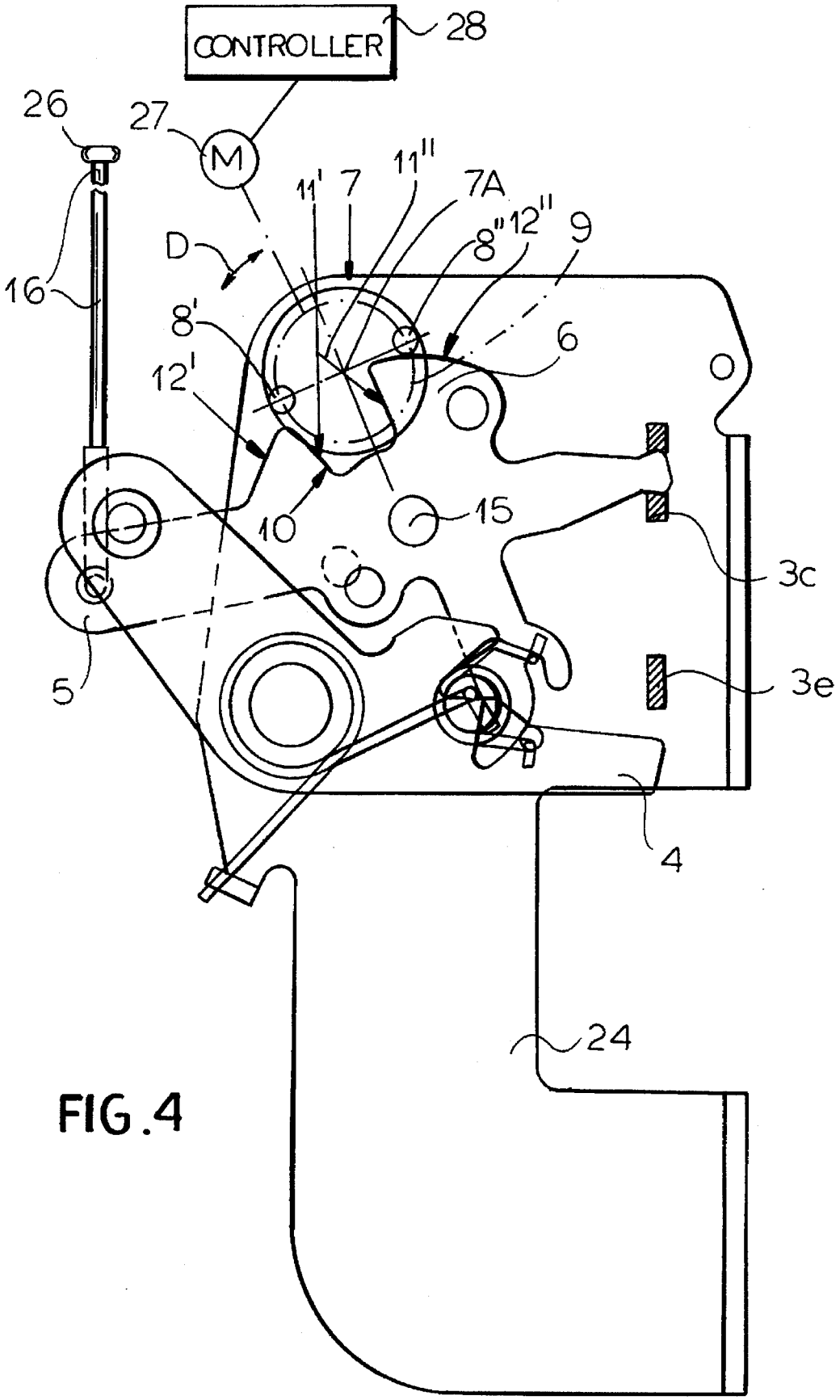
FIG. 4 is a section perpendicular to the section of FIG. 1 showing in partly diagrammatic form further elements of the latch.

FIG. 4 shows how the locking lever 5 is actually part of a central-locking element 6 pivotal on the housing 24 about an axis 15 perpendicular to the axes 1A and 2A. An outer end of this lever 5 is connected via a rod 16 to an inside locking button 26. A reversible electric motor 27 operated by a controller 28 can rotate a drive element 7 on the housing 24 about an axis 7A parallel to the axis 15. The element 7 carries a pair of diametrically opposite eccentric pins 8' and 8" movable through an orbit 9. The part 5, 6 is formed with a radially outwardly open cutout 10 having a pair of flank surfaces 11' and 11" engageable by the pins 8' and 8" and directed generally oppositely of a normal displacement direction D extending tangentially of an imaginary circle centered on the axis 15. The orbit 9 of these pins 8' and 8" extends partially through the cutout 10 and the part 5, 6 is formed to each side of the cutout 10 with radially directed stop surfaces 12' and 12" which are normally cushioned somewhat and that are engageable with the respective pins 8' and 8" also. The controller 28 operates the reversible motor 27 and monitors its current consumption to deenergize it when this current consumption exceeds a predetermined limit, indicating that the motor's rotation is blocked.

With this system, therefore, starting from the position of FIG. 4 the controller 28 sets the motor 27 to rotate the element 7 counterclockwise to unlock the door 25. This action will bring the pin 8' into contact with the unlocking flank 11" to pivot the part 5, 6 clockwise and push down the end of the lever 3*c*, thereby pulling up the pin 3*d*'. Almost immediately after the pin 8' engages the flank 11" and actuates the part 5, 6, the other pin 8" will engage the other stop surface 12' and further rotation of the element 7 will be blocked. The current consumption of the motor 27 will peak and the controller 28 will shut down the motor 27.

For locking the door the controller 28 reverses rotation of the motor 27 so that the blocked pin 8" moves back while the other pin 8' engages the locking flank 11' and pivots the part 5, 6 clockwise, reversing the sequence described above until the pin 8" returns to engagement with the surface 12" as shown in FIG. 4. This drops the pin 3*d*' and locks the latch.

Figure 5:
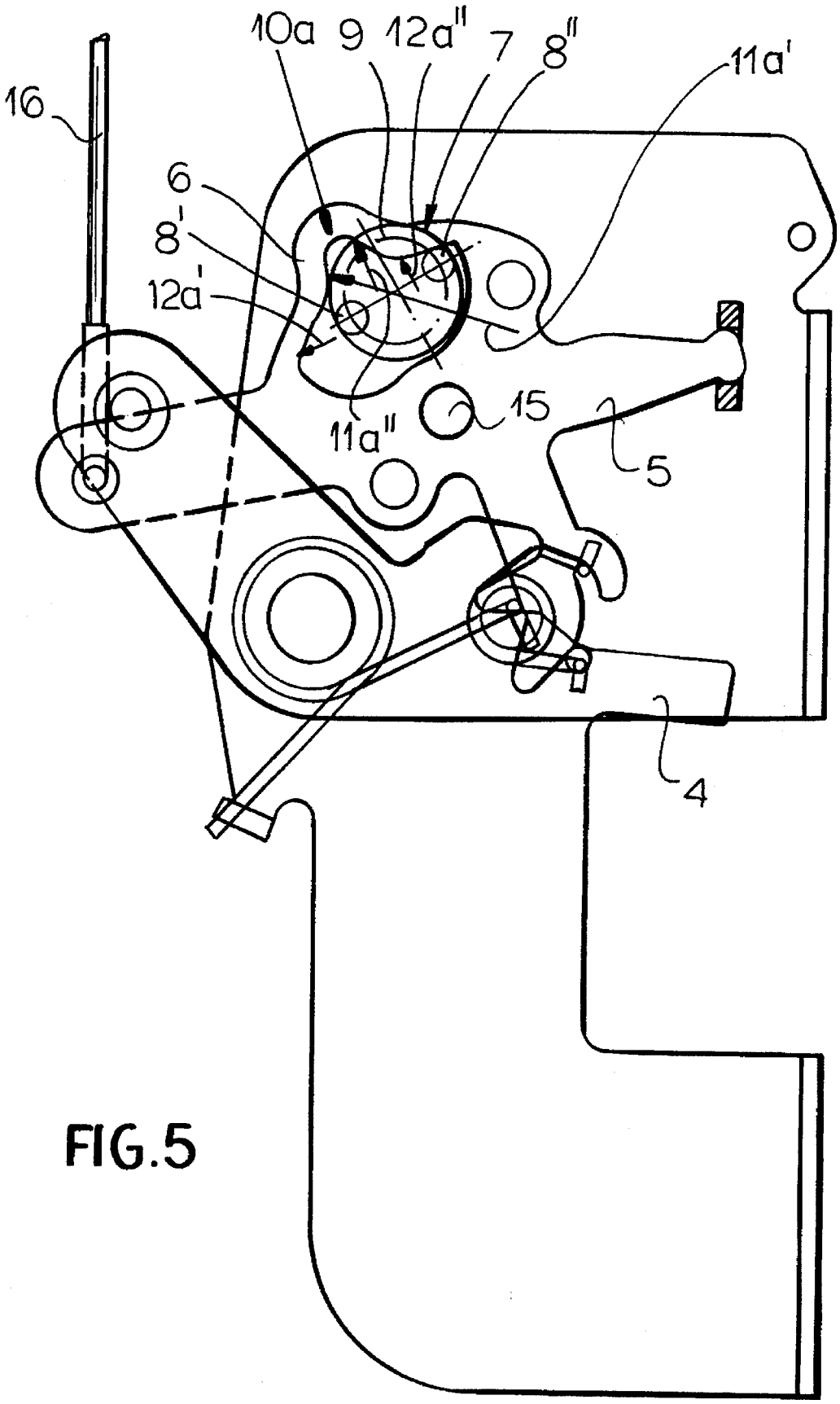
FIGS. 5 and 6 are views like FIG. 4 showing alternate systems according to the invention.

The system of FIG. 5 works similarly except that the cutout 10*a* is a hole so that its flanks 11*a*' and 11*a*" as well as the stop surfaces 12*a*' and 12*a*" are directed radially inward.

Figure 6:
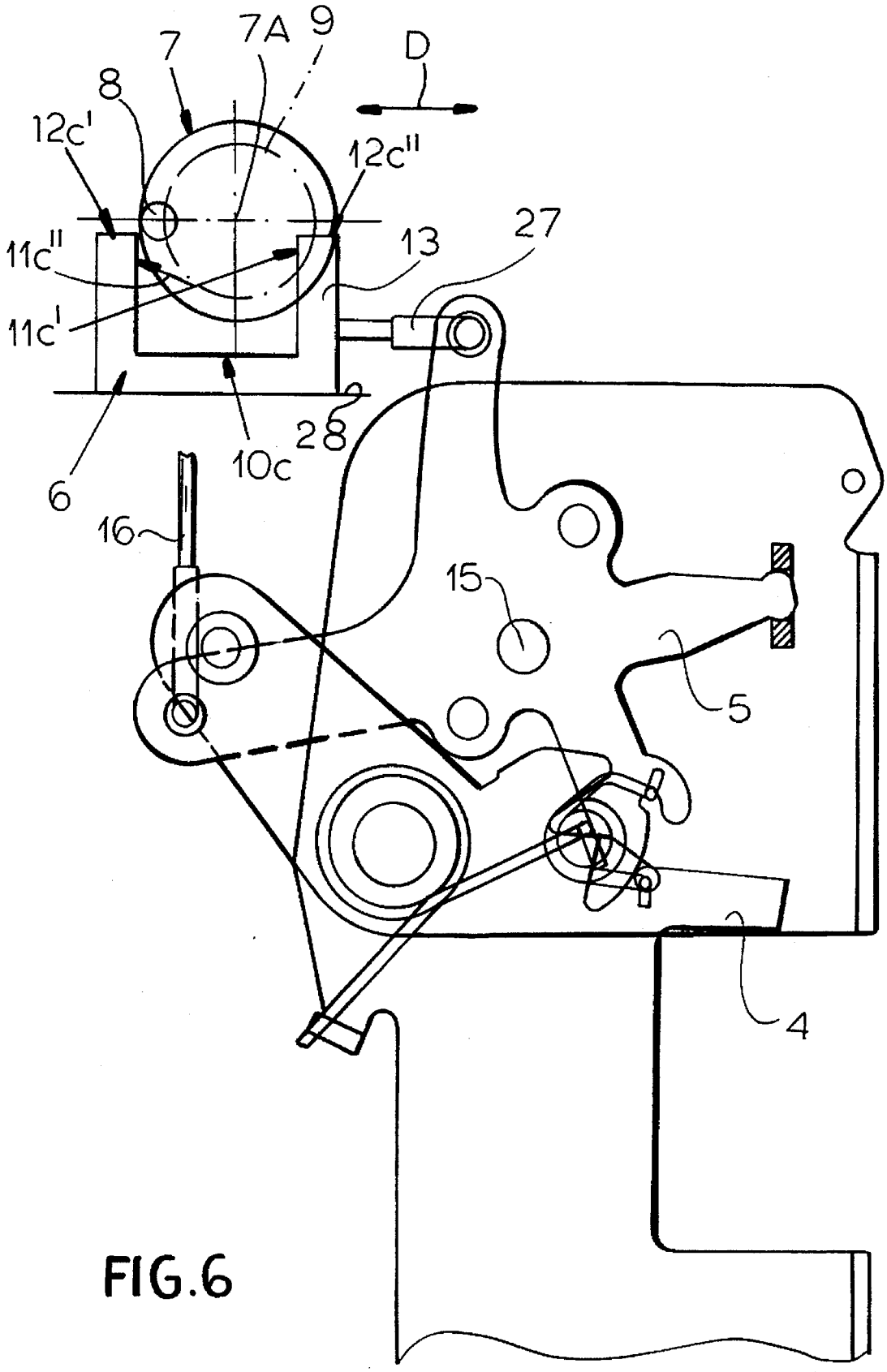

In FIG. 6 a slide 13 is displaceable linearly on a guide 28 of the housing 24 and is connected via a coupling 27 to the part 5. This slide 13 is formed with a cutout 10*c* having a pair of flanks 11*c*' and 11*c*" and a pair of stop surfaces 12*c*' and 12*c*". Once again, the orbit 9 extends mainly outside the cutout 10*c* but here the element 7 carries only one eccentric pin 8. Thus instead of a two-pin formation giving an angular stroke of about 180° between end positions of the drive element 7, the stroke is some 540°, in which case the sole pin 8 first engages the appropriate flank 11*c*' or 11*c*" and thereafter moves on to come to rest against the other stop surface 12*c*' or 12*c*".

Figure 7:
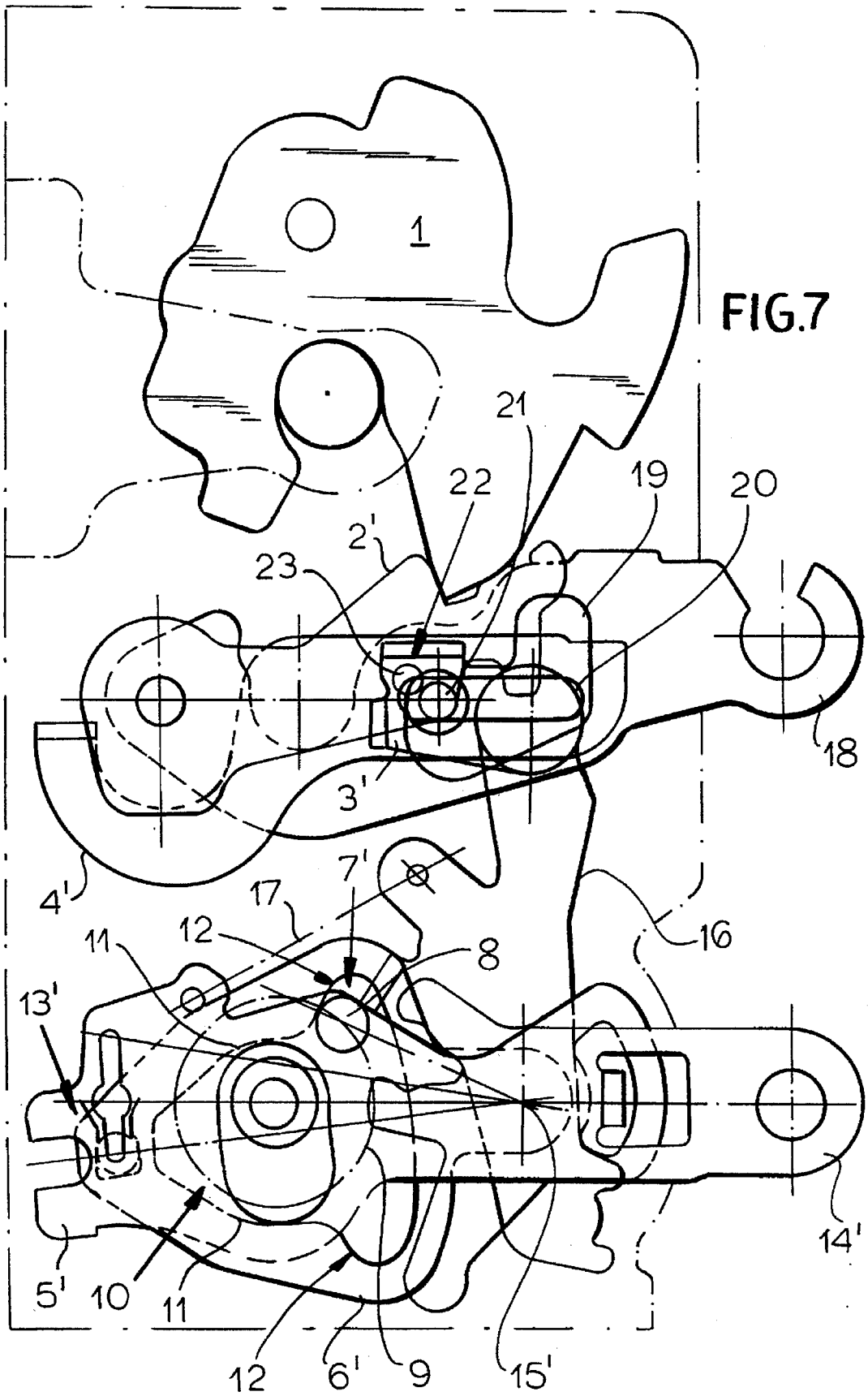
FIG. 7 is a section through another latch according to the invention in the unlocked position.

FIG. 7 also shows how the motor-vehicle door latch has a pivotal fork 1', a release pawl 2', and a release lever 3'. In addition it is provided with an actuating-lever system and a locking-lever system. The actuating-lever system more particularly has an inside actuating lever 4' and an outside actuating lever 18. The locking-lever system has an inside locking lever 5' as well as an outside locking lever 14'. The outside locking lever 14' as well as the inside locking lever 4' are pivotal about a common axis 15'. Also mounted on the pivot axis 15' is a transmission lever 16' which connects the locking lever system with the actuating lever system. The transmission lever 16' is connected via a spring element 17 with the inside locking lever 5'. This force-transmitting connection via the spring element 17 is set up such that the motor-vehicle door latch can be locked even if the outside actuating lever 18 and/or the inside actuating lever 4' are locked. In particular the release lever 3' is pivoted on the transmission lever 16'. The outside actuating lever 18 has a generally L-shaped cutout 19 and the inside actuating lever 4' has a longitudinally extending slot 20. The release lever 3 is provided with a guide pin 21 projecting through both the L-shaped cutout 19 and the slot 20. A cam edge 22 on the release lever 3 serves for releasing the release pawl 2. The cam edge 22 stays in the unlocked position of the transmission lever 16' in operative engagement with a release pin 23 of the pawl 2. On the other hand the cam edge 22 in the unlocked position of the transmission lever 16 is clear of the pin 23 of the pawl 2. In this manner the outside actuating lever 18 is disconnected in the locked position of the transmission lever 16, that is its actuation does not move the pawl 3'.

Figure 8:
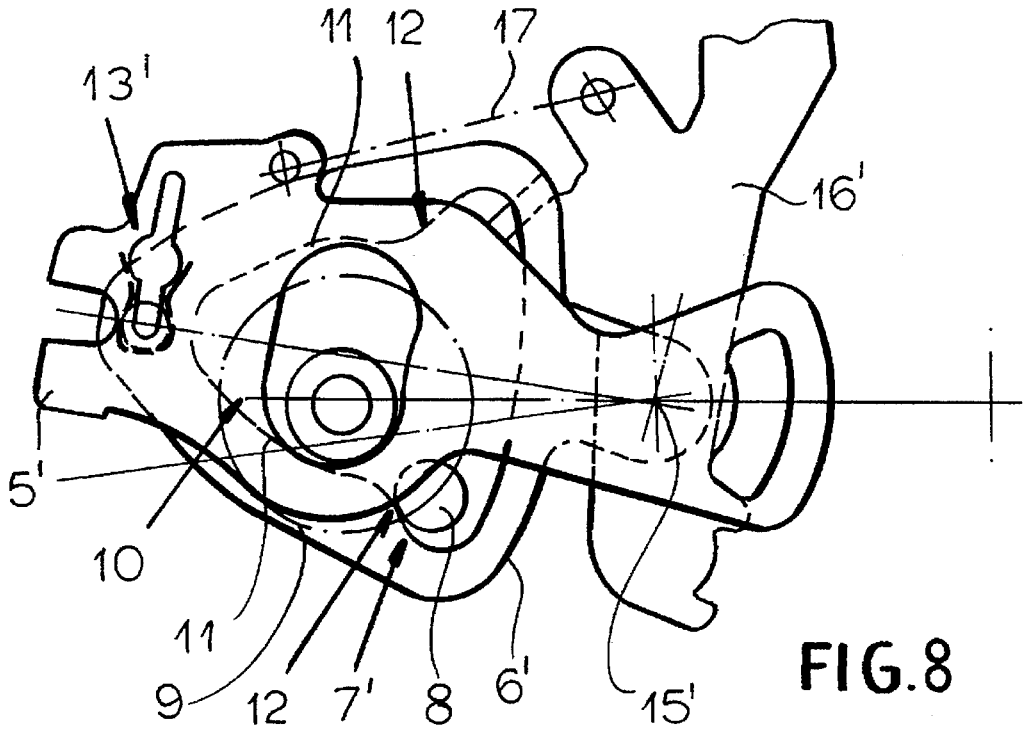
FIG. 8 is a view of a detail of FIG. 7 but with the parts in the locked position.
Figure 9:
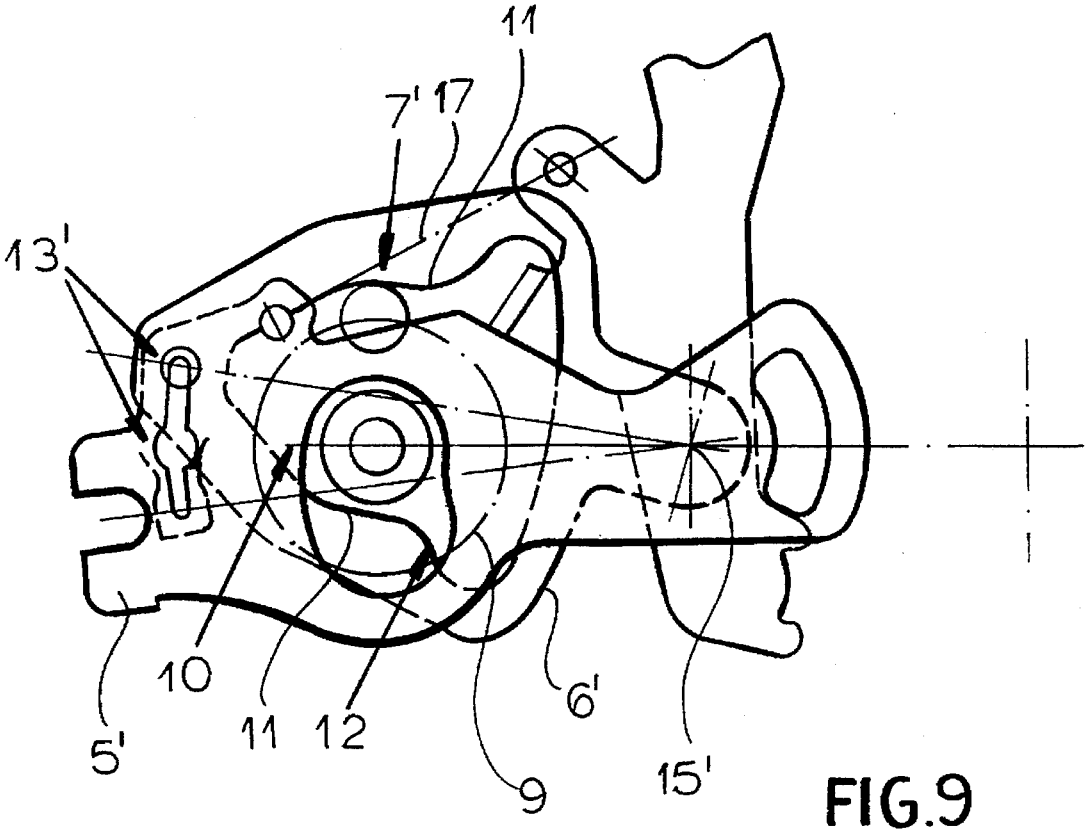
FIG. 9 is a view like FIG. 8 but with the inner locking lever actuated.

The motor-vehicle door latch shown in FIGS. 7 through 9 is further equipped with a central locking drive as well as with a central-locking element 6' connected to the locking lever system. The central locking drive is constituted as a reversible electric-motor drive which has an output element 7' with an eccentric control pin 8. The control pin is movable along an orbit 9 left and right to displace the central locking element 6' between the unlocked and locked positions. The central-locking element 6' has in particular a cutout 10 with lateral control surfaces 11 directed into the cutout 10 and confronting the control pin 8. The inside locking lever 5' and the central locking element 6' are connected to each other physically via an emergency unlocking connecting element 13' constituted as a spring clip on the element 6' and a pin on the lever 5'. A part of the orbit of the control pin 8 lies outside the cutout 10 of the central-locking element 6'. The central-locking element 6' has to each side of the cutout 1 a respective abutment surface 12 for the control pin 8. The positions of the control pin 8 are limited by running up of the control pin 8 against one of the abutment surfaces whereupon the electric-motor drive is cut off. This can be done by position-detecting switches and also by monitoring the increased current consumption of the motor when the pin 8 engages the abutment 12. The inside-locking lever 5' is also in this embodiment pivotal about the axis 15'. The cutout 10 of the central locking element 6' is open radially inwardly relative to the axis 15'.

In this embodiment the emergency-unlocking/connecting element 13' is formed as a force-transmitting snap connection so that the connection between the inside-locking lever 5' and the central-locking element 6' is releasable only toward the unlocked position of the inside locking lever 5'. As can be seen by a comparison of FIGS. 7 and 8 the inside-locking lever 5' and the central-locking element 6' under normal conditions, that is with no out-of the ordinary outside influences, act like a single part. Comparing FIGS. 7 and 8 with FIG. 9 shows however that in the case of an accidental blocking of the locked position of the central-locking element 6' it is still possible to effect an emergency unlocking. A sufficiently strong actuation of the inside-locking lever 5' will disconnect the emergency-unlocking/connecting element 13' and will unlock the motor-vehicle door latch even if the central-locking element 6' is set in the locked position. A strong subsequent actuation of the inside-locking lever 5' into the locked position again connects up the emergency element 13'. After restoration of the functionality of the motor drive (for example by charging of the vehicle's battery) the motor-vehicle door latch according to the invention is thus once again operational.

We claim:

1. A motor-vehicle door latch comprising:

a housing;

a lock fork on the housing engageable with a door bolt and pivotable between a holding position engaged around the bolt and retaining it on the housing and a freeing position permitting the door bolt to move into and out of the housing;

a release pawl engageable with the fork and displaceable between a latched position retaining the fork in the holding position and an unlatched position unengageable with the fork and permitting the fork to move into the freeing position;

means including a manual actuating mechanism movable between an actuated position and an unactuated position;

means including a coupling part displaceable on the housing between a coupling position connecting the actuating mechanism to the release pawl for displacement of the release pawl into the unlatched position on displacement of the actuating mechanism into the actuated position and a decoupling position for disconnecting the actuating mechanism from the release pawl, whereby in the decoupling position actuation of the actuating mechanism does not affect the release pawl;

a central locking element displaceable on the housing generally parallel to a predetermined direction between locked and unlocked positions, formed with a cutout opening transversely of the direction and having locking and unlocking flanks directed oppositely at least generally in the direction, and formed to each side of the cutout with an abutment surface directed generally perpendicular to the direction;

means including a locking mechanism jointly movable with the locking element and connected between the central locking element and the coupling part for displacing the coupling part into the decoupling position on displacement of the central locking element into the locked position and for displacing the coupling part into the coupling position on displacement of the central locking element into the unlocked position;

a drive body rotatable about a drive axis and having an eccentric pin formation defining on rotation of the drive body an orbit lying partially inside and partially outside the cutout; and means including a reversible electric motor for rotating the drive body and thereby orbiting the pin formation about the drive axis in one rotational sense for engaging the pin formation against the locking flank and displacing the central locking element into the locked position and thereafter engaging the pin formation against one of the abutment surfaces and thereby stopping the drive element and in the opposite rotational sense for engaging the pin formation against the unlocking flank and displacing the central locking element into the unlocked position and thereafter engaging the pin formation against the other of the abutment surfaces and thereby stopping the drive element.

2. The motor-vehicle door latch defined in claim 1, further comprising control means for cutting electrical energization of the motor on stopping of the pin formation against either of the abutment surfaces.

3. The motor-vehicle door latch defined in claim 1 wherein the housing includes a guide in which the central locking element is slidable in a straight line parallel to the direction.

4. The motor-vehicle door latch defined in claim 1 wherein the locking element is pivotal about an element axis, the direction extending tangentially of an imaginary circle centered on the element axis.

5. The motor-vehicle door latch defined in claim 4 wherein the cutout is a radially outwardly open notch and the abutment surfaces are radially outwardly directed edges of the locking element, the drive body being rotatable about an axis substantially parallel to and offset from the element axis.

6. The motor-vehicle door latch defined in claim 4 wherein the cutout is an axially open recess formed in the central locking element and the abutment surfaces are radially inwardly directed.

7. The motor-vehicle door latch defined in claim 1 wherein the pin formation includes a single pin and is rotatable through about 540° between end positions engaging the abutment surfaces.

8. The motor-vehicle door latch defined in claim 1 wherein the pin formation includes a pair of diametrically opposed pins that are rotatable through about 180° between end positions of the drive body in each of which a respective one of the pins engages a respective one of the abutment surfaces.

9. The motor-vehicle door latch defined in claim 1 wherein each abutment surface has an elastic coating.

10. The motor-vehicle door latch defined in claim 1 wherein the locking mechanism includes an inside locking lever directly connected to the coupling part for displacing same between its positions, the latch further comprising means in the locking mechanism including an emergency-release coupling for disconnecting the locking element from the coupling part and displacing the coupling part into the coupling position when, in the locked position of the locking element, the actuating mechanism exerts on the coupling force a force exceeding a predetermined threshold force in a direction urging the coupling part into the coupling position, whereby the manual actuating mechanism can override the central locking element.

11. The motor-vehicle door latch defined in claim 10 wherein the inside locking lever and central locking element are pivotal about a common axis on the housing.

12. The motor-vehicle door latch defined in claim 11 wherein the locking mechanism further includes an outside locking lever directly connected to the coupling part for displacing same between its positions and pivotal on the housing about the axis of the inside locking lever and central locking element.

13. The motor-vehicle door latch defined in claim 11 wherein the pin formation includes a single pin and is rotatable through about 480° between end positions engaging the abutment surfaces.

14. The motor-vehicle door latch defined in claim 11 wherein the emergency-release connection is a snap connection that only opens when the inside actuating lever is moved in a direction to unlock the latch while the central locking element is in the locked position.

15. The motor-vehicle door latch defined in claim 14 wherein the locking mechanism includes a transmission lever connected between the locking mechanism and the coupling part and a spring connected between the transmission lever and the locking lever and urging the locking lever into the unlocked position.

16. The motor-vehicle door latch defined in claim 15 wherein the actuating mechanism includes an outside locking lever coupled to the transmission lever, the outside locking lever being formed with an L-shaped opening and the inside locking lever is formed with an elongated slot aligned with the opening, the actuating mechanism having a pin projecting through the slot and opening and the mechanism further having a control edge for releasing the release pawl, the release pawl having a pin engageable with the control edge in the unlocked position and unengageable therewith in the locked position.

* * * * *